US006167742B1

(12) United States Patent
Marin

(10) Patent No.: US 6,167,742 B1
(45) Date of Patent: Jan. 2, 2001

(54) DRAWING AND COINING DIE FOR MANUFACTURING METAL CONTAINERS AND THE LIKE

(75) Inventor: Visino Marin, Casalbellotto (IT)

(73) Assignee: Attrezzeria M.V. di Marin Visino e C. S.n.c., Casalmaggiore (IT)

( * ) Notice: Under 35 U.S.C. 154(b), the term of this patent shall be extended for 0 days.

(21) Appl. No.: 09/199,484

(22) Filed: Nov. 25, 1998

(30) Foreign Application Priority Data

Nov. 28, 1997 (IT) ..... MN97A0042

(51) Int. Cl.[7] ..... B21D 24/08
(52) U.S. Cl. ..... 72/351; 72/348
(58) Field of Search ..... 72/348, 350, 351, 72/361, 453.13; 267/119

(56) References Cited

U.S. PATENT DOCUMENTS

| | | | | |
|---|---|---|---|---|
| 1,033,209 | * | 7/1912 | Stucki | 72/361 |
| 2,985,128 | * | 5/1961 | Hendrickson | 72/351 |
| 3,163,142 | * | 12/1964 | Buhrke | 72/356 |
| 3,296,850 | * | 1/1967 | Fiore | 72/351 |
| 3,452,578 | * | 7/1969 | Kirchner et al. | 72/348 |
| 3,654,795 | | 4/1972 | Freber . | |
| 3,955,394 | | 5/1976 | Kaufman et al. . | |
| 4,121,448 | * | 10/1978 | Censuales | 72/348 |

FOREIGN PATENT DOCUMENTS 609 907 10/1948 (GB) .

OTHER PUBLICATIONS

Patent Abstracts of Japan vol. 005, No. 206 (M–104), Dec. 26, 1981—& JP 56 122 634 A(Toshiba Corp), Sep. 26, 1981 *abstract*.

Patent Abstracts of Japan vol. 007, No. 250 (M–254), Nov. 8, 1983—& JP 58 1357 32 A (Shinsei Kinzoku Kogyo KK), Aug. 12, 1983 * abstract*.

* cited by examiner

*Primary Examiner*—Lowell A. Larson
(74) *Attorney, Agent, or Firm*—Guido Modiano; Albert Josif; Daniel O'Byrne

(57) ABSTRACT

A drawing and coining die for metal containers, comprising: a matrix, which is connected to a base associated with a moving slider of a press and comprises a sliding plate provided with elastic means in contrast with the base; a male element, which is connected to a base associated with a footing of the press and is shaped so as to make contact with an edge of the container; a blank holder, which is slidable in contact with the male element, is provided with movement means and comprises means for resting and centering a disk that constitutes the material to be processed.

8 Claims, 6 Drawing Sheets

DRAWING AND COINING DIE FOR MANUFACTURING METAL CONTAINERS AND THE LIKE

BACKGROUND OF THE INVENTION

The invention relates to a drawing and coining die for manufacturing metal containers and the like.

It is known that metal containers, such as for example pans in their many constructive shapes, and similar items, are manufactured by means of dies associated with a press. The finished product is obtained starting from a metal disk which is first drawn by the action of a male element combined with a matrix, assuming the intended shape without substantial changes in thickness, and with a final coining to obtain a shape which is modulated with different thicknesses.

SUMMARY OF THE INVENTION

The aim of the present invention is to provide a die which has improved characteristics with respect to existing dies.

This aim is achieved by a drawing and coining die for manufacturing metal containers and the like, according to the invention, characterized in that: a matrix, which is connected to an upper base adapted to be associated with a moving slider of a press and comprises a plate slidingly associated at the bottom and is provided with elastic means in contrast with said upper base; a male element, which is connected to a lower base adapted to be associated with a footing of a press and is shaped so as to make contact with an edge of a resulting container; a blank holder, which is slidable in contact with the male element, is provided with underlying movement means and comprises, at an upper face, means for resting and centering a disk that constitutes the material to be processed.

BRIEF DESCRIPTION OF THE DRAWINGS

Further characteristics and advantages of the invention will become apparent from the description of a preferred but not exclusive embodiment thereof, illustrated by way of non limitative example in the accompanying drawings, wherein.

DESCRIPTION OF THE PREFERRED EMBODIMENTS

Figure 1:
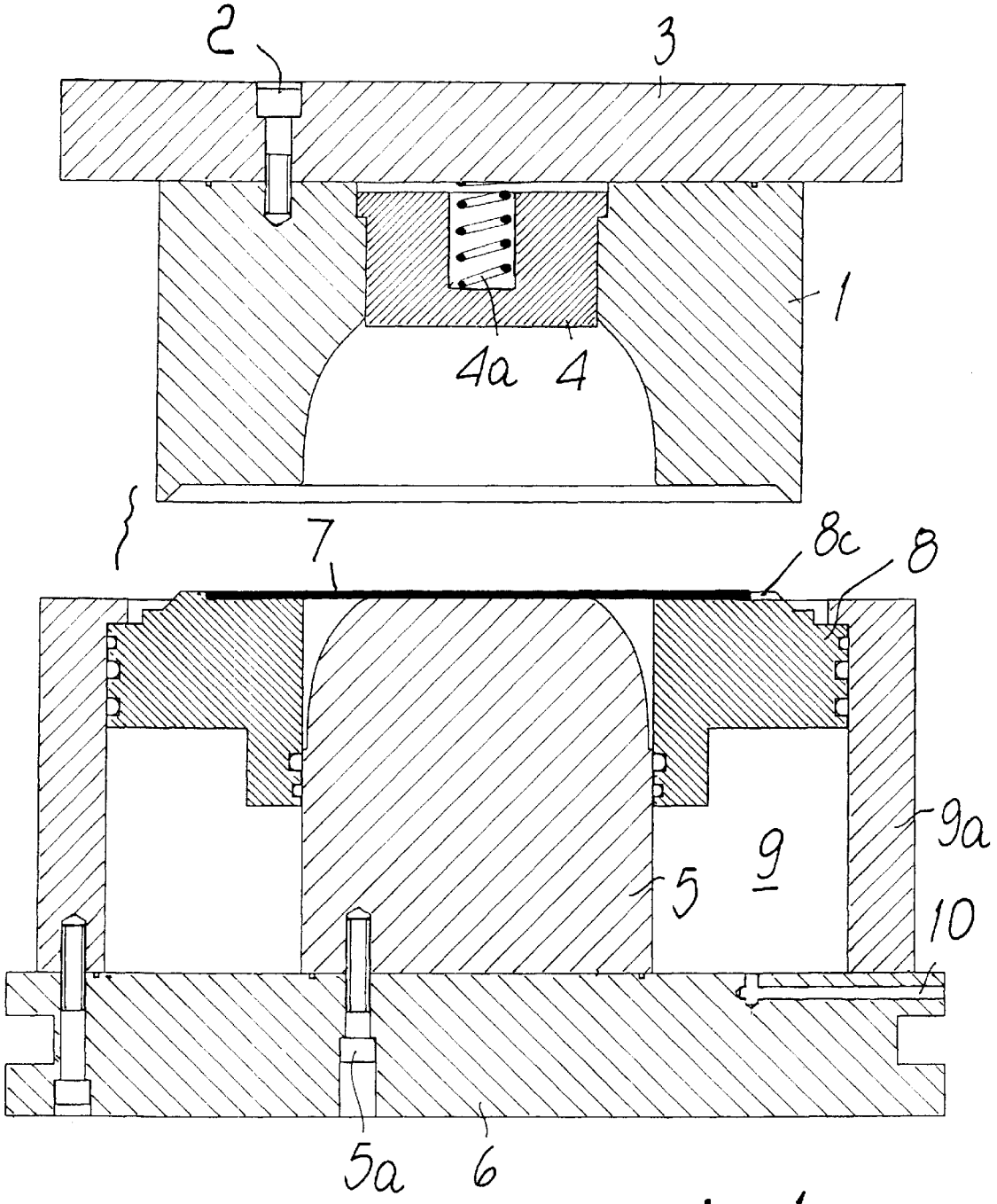
FIG. 1 is a view of the die of the present invention in the open condition.

With reference to the above Figures, 1 designates a matrix, which is connected by means of screws 2 to an upper base 3, which is adapted to be associated with a moving slider of a press, and the reference numeral 4 designates a plate slidable within the matrix in contrast with elastic means, such as a spring 4*a*, which are interposed between the plate and the upper base 3.

The reference numeral 5 designates a male element which is connected, by means of screws 5*a,* to a lower base 6 which is adapted to be associated with a footing of the press. The male element is shaped so as to make contact in region 5*b,* as shown in the detail of FIG. 6, with an edge of the container, designated by 7*b* in FIGS. 4 to 8, which is obtained from a disk designated by the reference numeral 7 in FIGS. 1 and 2 thanks to several modification steps such as the step designated by 7*a* in FIG. 3.

Figure 6:
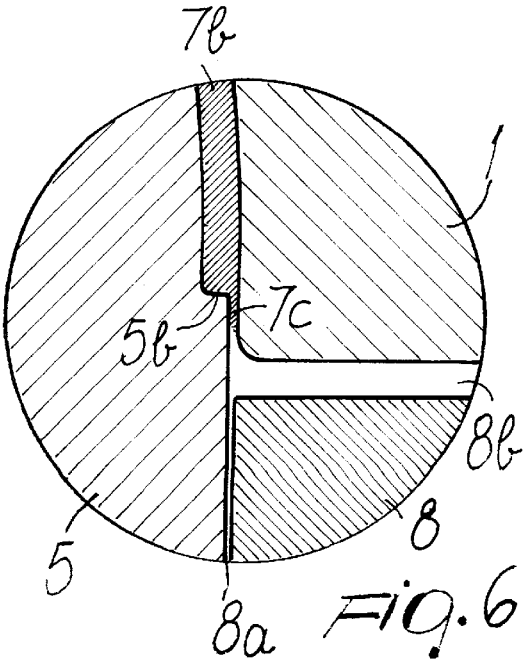

FIG. 6 clearly shows that the male element 5 is shaped so as to make contact with the edge of the container 7*b* except for a band which is located in an outer peripheral region of the edge, at which a burr 7*c,* mentioned hereinafter, has formed.

Figure 5:
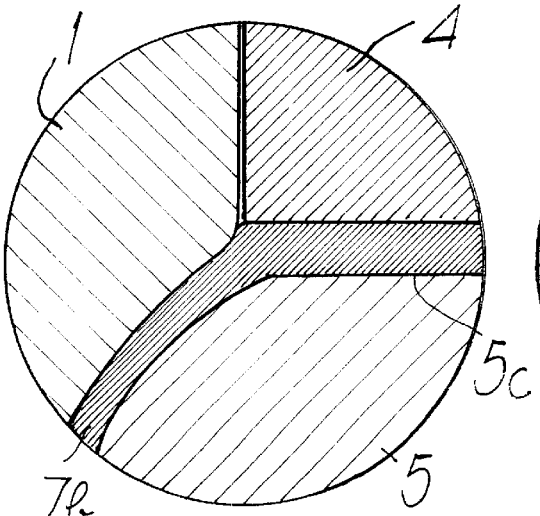
FIGS. 5 and 6 are enlarged-scale views of details of the circled regions of FIG. 4.

FIG. 5 instead illustrates another feature of the die according to the invention consisting in that, as will be explained hereinafter, the plate 4 is slightly larger than the dimensions of the end cross-section 5*c* of the male element 5.

The reference numeral 8 designates the blank holder, which is slidable hermetically within a chamber 9 formed by a wall 9*a;* compressed air is fed into the chamber 9 through a duct 10 and constitutes means for moving the blank holder according to an automatic operating criterion described hereinafter.

The blank holder 8 has a band which is located in the peripheral region proximate to the male element 5 and protrudes onto the impression formed in the matrix so as to form a shape which is complementary to the shape of the container. Accordingly, a clearance 8*a* which is smaller than the thickness of the burr 7*c* is formed between the blank holder 8 and the male element 5 and comprises, at its upper face, a portion of space 8*b* for containing and centering the disk 7 that constitutes the material to be processed. The portion of space is provided with a region 8*c* which allows the passage of the finished product; different means for the resting and centering of the disk might comprise repulsion elements accommodated within the blank holder 8.

The operation of the invention is now described starting from the condition in which the die is open, as shown in FIG. 1.

Figure 2:
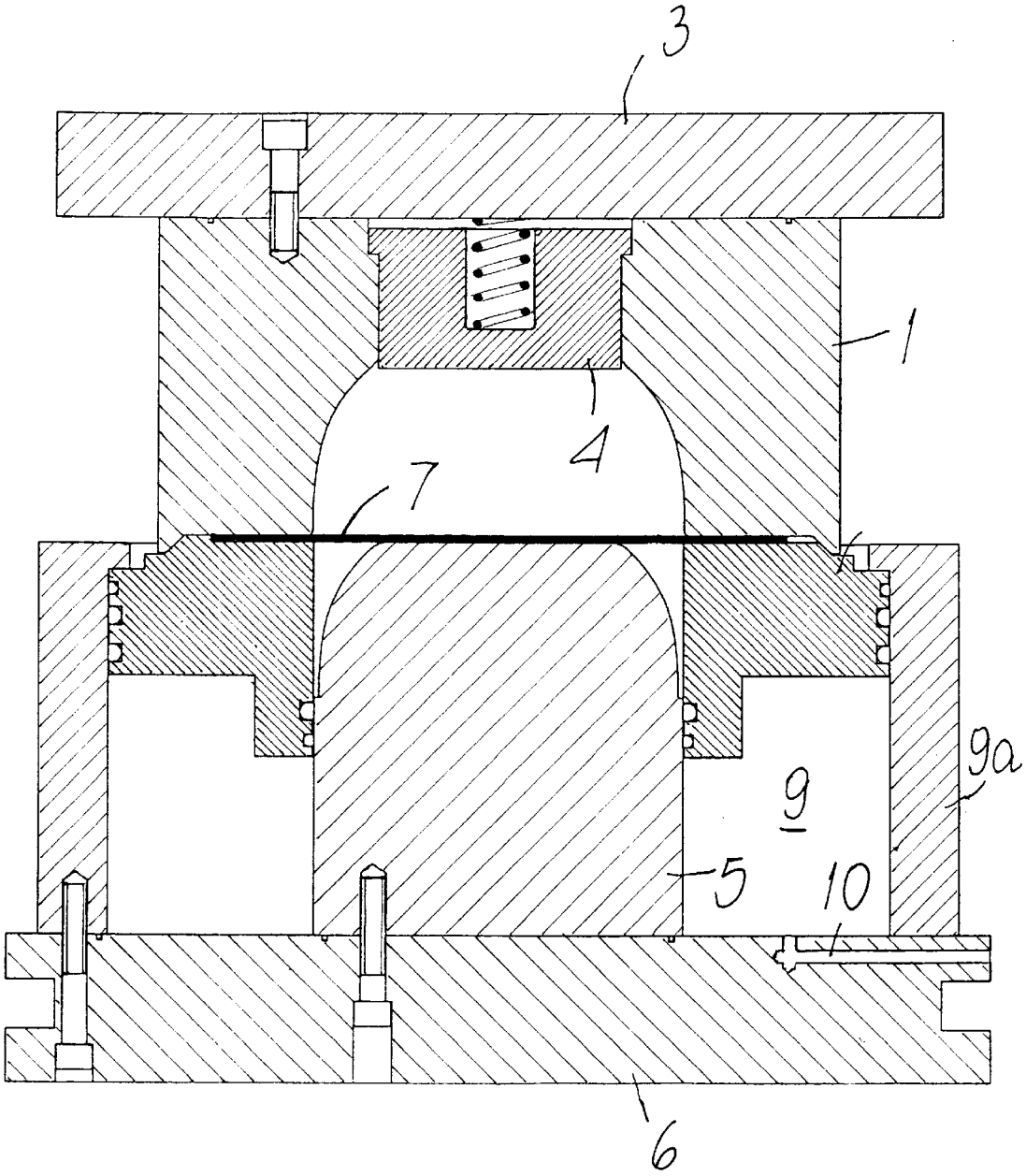
FIGS. 2 and 3 are views of successive steps of the closure of the die.

The upper base 3 moves downwards and the matrix 1, after making contact with the disk 7 in the condition of FIG. 2, draws the disk in contact with the male element 5, with a descent of the blank holder 8 which is controlled by the underlying compressed air in the chamber 9.

Figure 3:
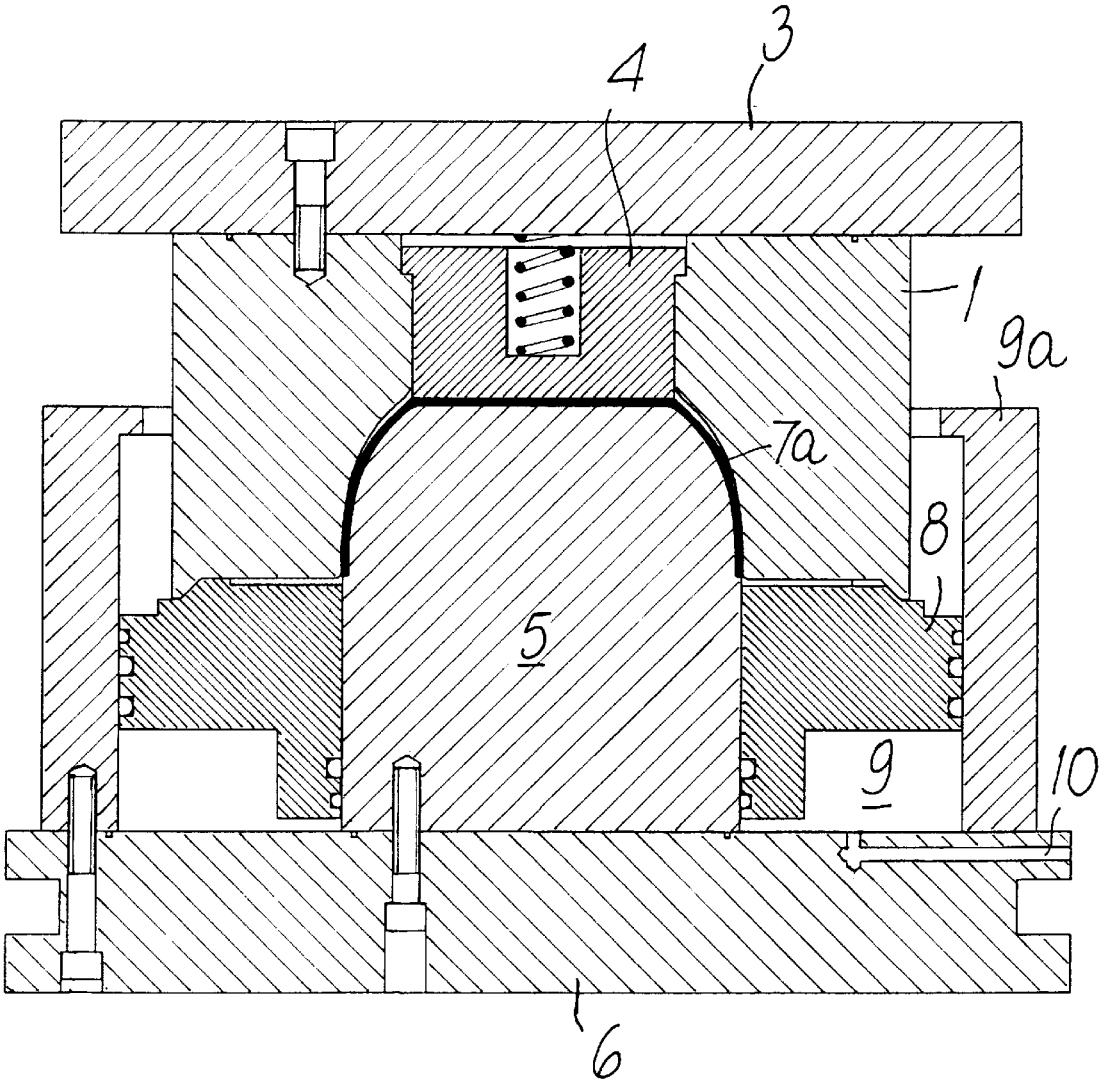
Figure 4:
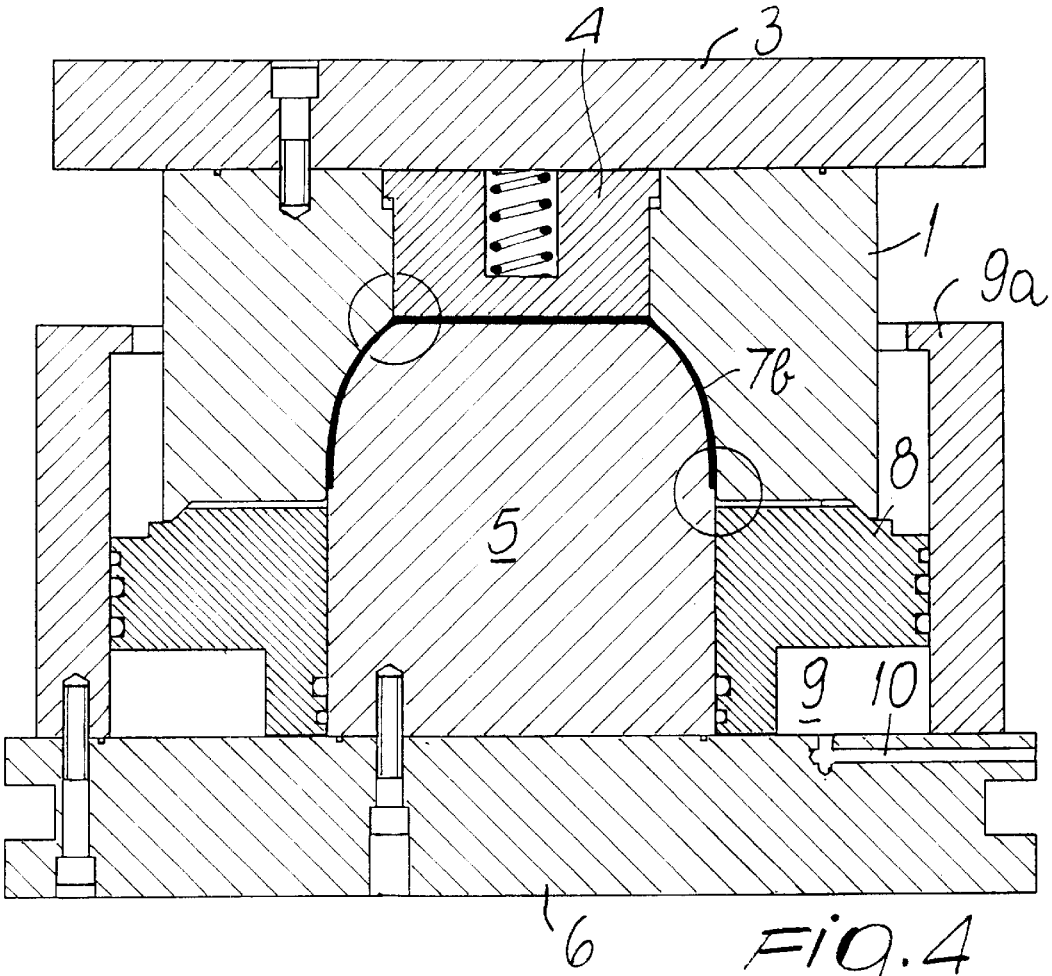
FIG. 4 is a view of the die of the present invention in the closed condition with the finished part.

The configuration of FIG. 3 is thus obtained, with the plate 4 in contact with the now-deformed material 7*a;* the further descent of the base 3, which occurs with an upward sliding of the plate 4 and with a compression of the spring 4*a,* completes the drawing operation and produces the final coining operation with a compression of the product which causes a migration of material within the impression so as to give said product the configuration 7*b* having a modulated thickness as shown in FIGS. 4 to 8. FIG. 4 indeed illustrates the situation in which the die is closed and the product is perfectly formed.

During the coining step, the material that migrates inside the impression between the male element 5 and the matrix 1 reaches the regions of the impression where the clearance shown in FIG. 5 between the matrix 1 and the plate 4 and the clearance shown in FIG. 6 between the matrix 1 and the male element 5 are provided when the migration is ending. This eliminates the passage of material into the clearance between the matrix and the plate, causing a consequent lack of burr, and causes a controlled passage of material into the clearance between the matrix and the male element to form minimal burr 7*c* or even no burr at all.

Figure 7:
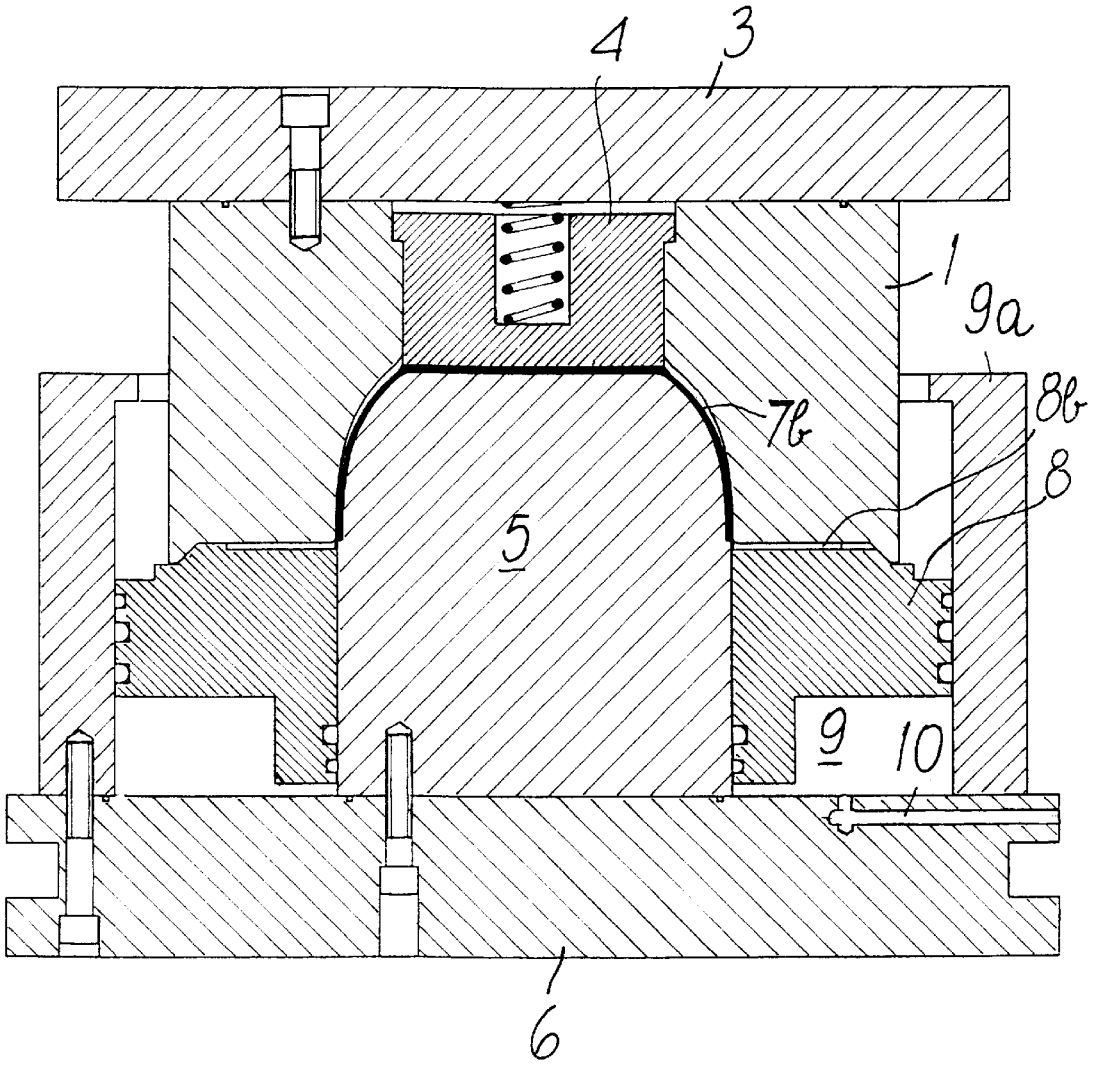
FIGS. 7 and 8 are views of successive steps of the opening of the die.

In the first step of the ascent of the base 3, which ends with the configuration of FIG. 7, the plate 4 remains in contact with the finished part 7*b,* which is locked on the male element 5, preventing it from remaining attached to the matrix 1, which would interrupt the continuous automatic operation of the die.

Figure 8:
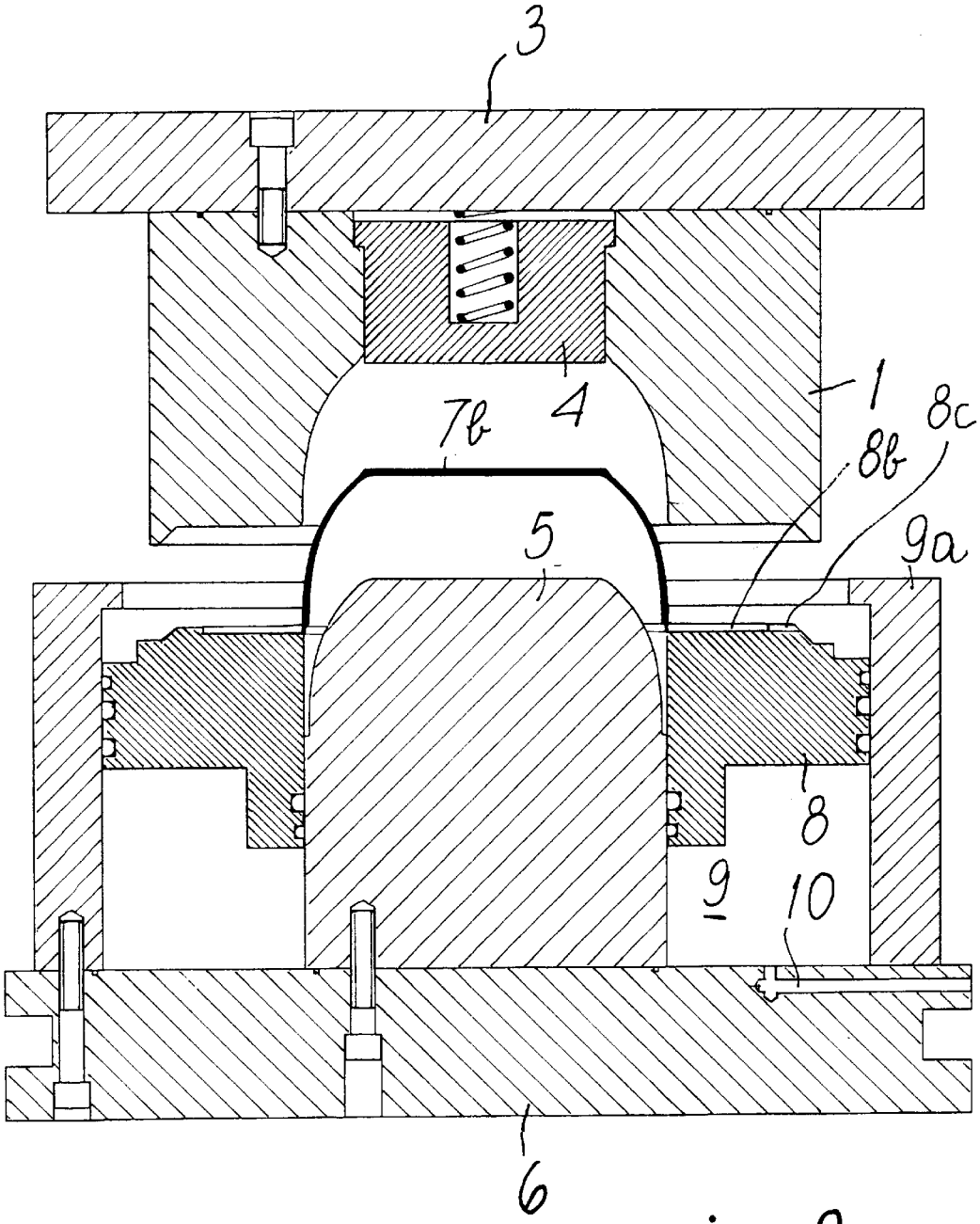

While the base 3 continues its ascent, the blank holder 8 also rises by being pushed by the compressed air in the chamber 9, which is adjusted by adapted means connected to the duct 10, makes contact with the burr 7*c* or, if no burr is present, it makes direct contact with the peripheral band of the edge of the container 7*b* that is not covered by the region 5*b* of the male element, and causes the separation of the finished part 7*b* from the male element 5 and its lifting, which continues, advancing through steps such as the step shown in FIG. 8, until it can be received by an extractor arm, passing through the region 8*c*.

The burr 7*c* is then removed with a finishing pass.

The die according to the present invention is susceptible of numerous modifications and variations, all of which are within the scope of the inventive concept. Thus, for example, the blank holder 8 can be provided with movement means which comprise shafts protruding from the footing of the press and managed by a fluid-actuated system with which the press is equipped, or the movement means can comprise elastic elements.

The male element may also be shaped so as to make contact with the edge of the container 7*b* as a whole; in this case, the blank holder no longer has a band which protrudes onto the edge and therefore is no longer able to act as an element for extracting the finished part from the male element as described.

In the practical execution of the invention, all the details may be replaced with other technically equivalent elements; the materials used, as well as the shapes and the dimensions, may be any according to requirements.

The disclosures in Italian Patent Application No. MN97A000042 from which this application claims priority are incorporated herein by reference.

What is claimed is:

1. A drawing and coining die for manufacturing metal containers and the like, comprising;

a matrix, which is connected to an upper base adapted to be associated with a moving slider of a press and comprises a plate slidingly connected at a bottom of the matrix and is provided with elastic means interposed between said upper base and said plate so as to bias said plate away from said under base;

a male element, which is connected to a lower base adapted to be associated with a footing of the press such that said matrix is linearly movable with respect to said male element, said male element being shaped so as to make contact with an edge of the resulting container;

a blank holder, which is slidable arranged in contact with and surrounding the male element, is provided with underlying movement means for moving said blank holder with respect to said male element and said blank holder comprises, at an upper face, means for resting and centering a disk that constitutes the material to be processed;

said matrix and said male element and said blank holder being configured such that in an initial loading position of said die said matrix is spaced distally from said male element and further said blank holder is positioned with respect to said male element for receiving the disk on said means for resting and centering said disk of said blank holder;

said matrix and said male element and said blank holder being further configured such that in an initial contact position said matrix has been moved with respect to said male element with respect to said initial loading position such that said matrix engages on top of said disk and said blank holder;

said matrix and said male element and said blank holder being further configured such that during a drawing phase of said die said matrix moves together with said blank holder down about said male element to draw said disk between said matrix and said male element until a final state of said drawing phase is obtained in which said disk is disengaged completely from said means for resting and centering said disk of said blank holder, and in which said disk is completely arranged between said matrix and said male element and said plate of said matrix makes contact with said disk, and in which a circumferential contact region of said male element makes contact with said edge of the container resulting from said disk; and said matrix and said male element and said blank holder being further configured such that during a coining phase of said die said matrix moves together with said blank holder further down about said male element to coin said disk, and said plate of said blank holder moves upwardly with respect to said matrix towards said upper base in contrast with said elastic means, and said circumferential contact region of said male element makes contact with said edge of the container resulting from said disk.

2. The die according to claim 1, wherein said circumferential contact region of the male element is shaped so as to make contact with the edge of the resulting container, except only for a band located in the outer peripheral region of the edge.

3. The die according to claim 1, wherein said circumferential contact region of the male element is shaped so as to make contact with the edge of the resulting container as a whole.

4. The die according to claim 1, wherein the disk is slightly larger than the dimensions of an end cross-section of the male element.

5. The die according to claim 1, wherein the blank holder is slidable hermetically in a chamber for containing, in a region below said blank holder, compressed air which constitutes a movement means and is fed through a feed duct by actuation means according to an automatic operating program.

6. The die according to claim 1, wherein the blank holder is provided with underlying elastic movement means.

7. The die according to claim 1, wherein the blank holder comprises, at the upper face, a portion of space for containing and centering the disk that constitutes the material to be processed, said portion being provided with a region which allows the passage of the resulting container.

8. The die according to claim 1, wherein the blank holder comprises, at the upper face, repeller elements for centering the disk that constitutes the material to be processed.

* * * * *